US005788092A

United States Patent [19]

Teeney

[11] Patent Number: 5,788,092

[45] Date of Patent: Aug. 4, 1998

[54] WALL ATTACHED TOOL RACK

[76] Inventor: David D. Teeney, 2130 Dundas Way, Mosier, Oreg. 97040-9782

[21] Appl. No.: 739,055

[22] Filed: Oct. 28, 1996

Related U.S. Application Data

[63] Continuation-in-part of Ser. No. 693,855, Aug. 5, 1996.

[51] Int. Cl.[6] ..... A47F 7/00

[52] U.S. Cl. ..... 211/70.6; 211/181; 248/175

[58] Field of Search ..... 211/70.6, 60.1, 211/63, 65, 67, 68, 70.5, 106, 181, 66; 248/175, 153, 302

[56] References Cited

U.S. PATENT DOCUMENTS

| | | | |
|---|---|---|---|
| D. 318,349 | 7/1991 | Nass | 211/106 X |
| 1,514,375 | 11/1924 | Crimmel | 211/181 X |
| 1,598,340 | 8/1926 | Decher | 211/181 X |
| 1,959,454 | 5/1934 | Biescar | 211/181 |
| 2,923,415 | 2/1960 | Brown | 211/106 X |
| 2,930,486 | 3/1960 | Hoover | 211/181 X |
| 3,003,644 | 10/1961 | Hildebrand | 211/181 X |
| 3,113,400 | 12/1963 | Emond | 211/181 X |
| 3,268,087 | 8/1966 | Kramer | 211/70.6 X |
| 4,025,013 | 5/1977 | Anantharaman | 211/181 X |
| 4,234,094 | 11/1980 | Jorgensen | 211/106 X |
| 4,318,478 | 3/1982 | De Winter | 211/60.1 X |
| 4,345,688 | 8/1982 | De Boer | 211/70.6 |
| 4,819,899 | 4/1989 | Weil | 248/175 |
| 5,143,228 | 9/1992 | Arnold | 211/70.6 |
| 5,169,010 | 12/1992 | Fortner | 211/181 X |
| 5,495,954 | 3/1996 | Schmit | 211/94 X |

FOREIGN PATENT DOCUMENTS

| | | | |
|---|---|---|---|
| 2428423 | 2/1980 | France | 211/70.6 |

*Primary Examiner*—Ramon O. Ramirez
*Assistant Examiner*—Anita M. King
*Attorney, Agent, or Firm*—James D. Givnan, Jr.

[57] ABSTRACT

A tool rack includes main frame members each having legs for installation in abutment with a building wall structure. Arm segments of the main frame members project rearwardly and carry, at their distal ends, a bracket attachable to building wall structure offset horizontally from the first mentioned building wall structure. The bracket defines a fastener receiving, elongate area exceeding the distance between adjacent wall studs of the wall structure. Pairs of upper and lower rails carry barrier components to define areas for reception of tools or other articles. A modified tool rack includes front and rear frames joined by barriers defining tool receiving areas. Arms on the frames extend rearwardly and support, at their distal ends, brackets defining a lengthwise extending open area to receive wall insertable fasteners.

4 Claims, 2 Drawing Sheets

WALL ATTACHED TOOL RACK

This application is a continuation-in-part of pending application Ser. No. 08/693,855 filed Aug. 5, 1996 by the present inventor.

BACKGROUND OF THE INVENTION

The present invention pertains generally to racks for the orderly storage of tools, sporting goods and other elongate articles lending themselves to storage in an upright manner.

U.S. Pat. No. 3,138,359 discloses a picture or mirror support for wall attachment wherein a horizontal member is provided with elongate openings to permit attachment to wall studs spaced apart on a range of centers. U.S. Pat. No. 3,298,531 discloses a tool rack having vertically spaced, aligned openings to receive the elongate handles of a variety of tools. The upper and lower rack components are not unitary nor constructed from welded rod. U.S. Pat. No. 4,140,256 discloses a tool holder of wire and rod construction with a pan for small articles. A wire grid receives small hand tools in aligned openings defined by wire components. U.S. Pat. No. 4,345,688 discloses a tool holder formed from wire with grid like openings being provided for reception of small inserted hand tools. U.S. Des. Pat. No. 355,841 discloses a rack having a pair of parallel rods secured in spaced relationship from which depend a series of hook like supports. U.S. Des. Pat. No. 342,854 discloses a sports equipment holder for wall attachment having bent rod members on which is supported a wire basket.

SUMMARY OF THE PRESENT INVENTION

The present invention is embodied within a tool storage rack adapted for wall attachment adjacent a garage foundation.

Upright main frame members serve to carry vertically spaced pairs of rails which, in turn, carry barriers which define tool receiving areas of the rack. Arm segments of the rack are integral with the upper ends of said main frame members and project horizontally and terminate in upturned end segments which serve to carry a bracket for attachment to wall structure in a manner permitting adjustment. The configuration of the rack provides for storage of tools, sporting goods and other like articles in a compact, unobtrusive manner against a wall structure of a garage, basement, storage shed, etc. The bracket of the rack permits attachment to a wall in an adjustable manner to enable convenient repositioning and securement of the rack in place. A suitable bracket includes spaced apart members defining an elongate opening encompassing the span between all commonly spaced wall studs to permit rack securement by wall inserted fasteners. The rack provides a multitude of tool receiving open areas which permit the storage of garden tools and/or athletic equipment in proximity of a wall so as to maximize use of space available for storage. The bracket arrangement permits securement of the rack to adjacent wall studs throughout a range of spacing or, if desired, a single wall stud. The bracket is offset horizontally from upright frame members of the rack to permit such members to abut a garage stem wall for added stability.

A modified tool storage rack includes fore and aft spaced apart, rectangular frames joined together by upper and lower series of barriers defining multiple tool receiving areas. A pair of arms extends rearwardly from the frames and thereat support a pair of spaced apart rods between which fasteners are insertable for securement of the rack to wall structure. Rack legs project downwardly from oppositely located barriers adjacent ends of the rack. The modified rack lends itself to low cost production operations.

Important objectives of the present invention include the provision of a rack constructed from steel rod for unobtrusive disposition along and close to a building wall; the provision of a storage rack constructed from low cost steel rod lending itself to economical yet sturdy construction; the provision of a storage rack including a bracket defining an elongate opening to provide a space encompassing distances between wall studs to enable rack securement to such studs regardless of the range of spacing therebetween under various building codes.

DETAILED DESCRIPTION OF THE PREFERRED EMBODIMENTS

Figure 1:
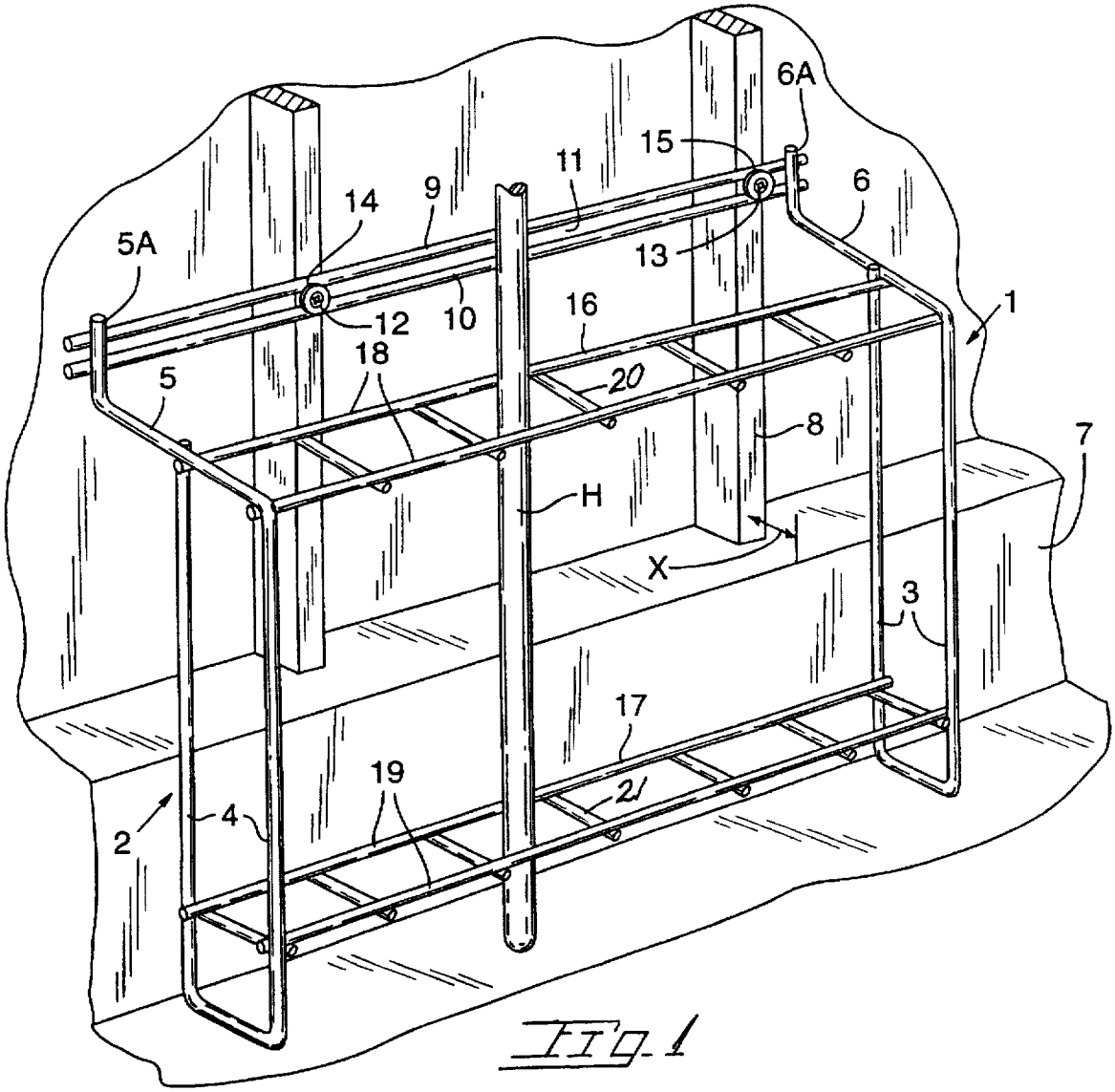
FIG. 1 is a perspective view of the present tool rack.

With continuing attention to the drawings wherein applied reference numerals indicate parts similarly hereinafter identified, upright main frame members of the rack are indicated generally at 1 and 2 with each member 1 and 2 having parallel spaced apart legs at 3 and 4.

Rack arm segments at 5 and 6 extend rearwardly in a horizontal manner from said main frame members a distance of approximately the distance between the vertical surface of a stem wall face 7 and the front edge 8 of a wall stud 45 with such a distance indicated at X. Preferably arm segments 5 and 6 are formed as a continuation of each rod forming the main frame members to enable the arm segments to be a continuation thereof. Upturned arm end segments at 5A and 6A project upwardly in a manner to receive brackets at 9 and 10 secured to arm segments 5A and 6A by suitable means such as welds (not shown). The spaced brackets 9 and 10 define an elongate opening 11 in which may be received a pair of fasteners 12 and 13 for securement to wall studs 45 and equipped with washers at 14 and 15.

Adjacent the upper and lower extremes of upright frame members 1 and 2 are upper and lower racks 16 and 17 each including rails 18 and 20 19 secured at their ends to the upright main frame members. Barriers at 20 and 21 define open areas for tool reception, as for example, the inserted tool handle at H. A floor is at F.

Figure 2:
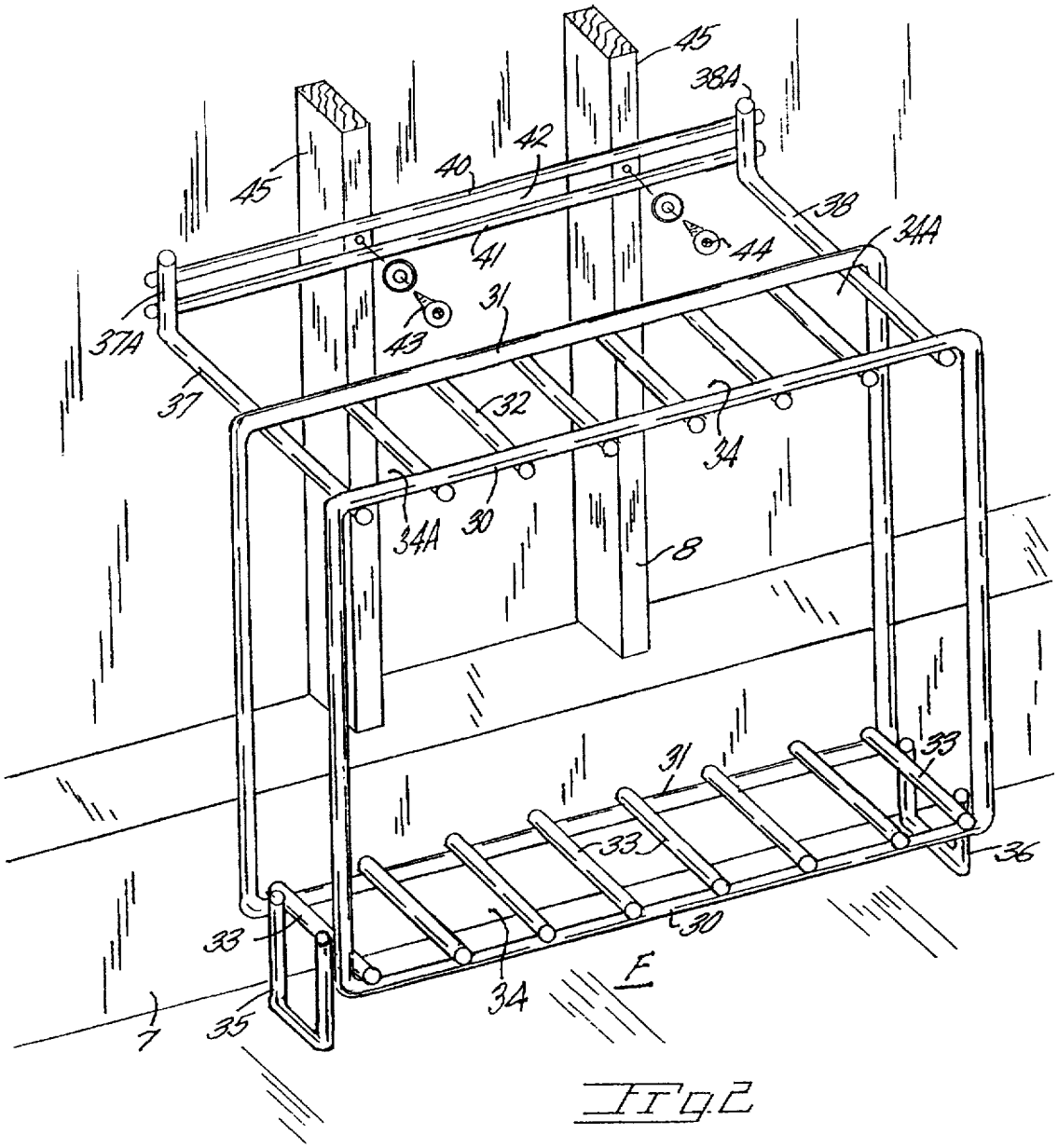
FIG. 2 is a view similar to FIG. 1 but showing a modified form of the tool rack.

With attention to FIG. 2 which illustrates a preferred modified form of the present rack and being of welded rod construction with a pair of fore and aft or front to rear spaced apart upright frames 30–31 of rectangular shape provided with an interconnecting upper series of barriers 32 while the lowermost frame components are provided with a second series of barriers 33. The barriers 32 and 33 define vertically aligned open areas as at 34 for the reception of tool handles, sports equipment, building supplies, etc. Depending from the end located, lower barriers 33 are legs 35 and 36 which depend in a vertical manner or alternatively in an outwardly inclined manner, the latter contributing to rack lateral stability.

Rack arms 37–38 project rearwardly from frames 30–31, adjacent the sides of the frames, and have upturned distal end segments 37A–38A on which are carried rod shaped brackets 40–41 which jointly define a slot or elongate open area 42 extending lengthwise of the rack preferably at least 24 inches to provide a lengthy open area adequate to receive stud engaging fasteners 43–44 regardless of variances in spacing between wall studs 45 which may occur under different local building codes up to 24 inches between wall stud centers. The washer equipped fasteners when seated in a snug manner against the brackets 40–41 prohibit any tipping of the rack regardless of the rack being overbalanced by stored tools of extraordinary length. As with the earlier described rack, the modified rack is laterally positionable upon loosening of fasteners 43–44. Rack arms 37–38 partially define additional open areas at 34A.

While I have shown but a few embodiments of the invention, it will be apparent to those skilled in the art that the invention may be embodied still otherwise without departing from the spirit and scope of the invention.

Having thus described the invention, what is claimed and desired to be secured by a Letters Patent is:

1. A tool storage rack for floor support and attachment to the wall structure of a building to store elongate tools each of the tools in a spaced apart upright manner and comprising, front and rear upright rectangular frame members spaced apart in a front to rear manner and in mutual horizontal alignment, an upper series and a lower series of tool and barriers for the tools connecting the frame members in horizontally spaced relationship; said frame members, said upper series of tool barriers and said lower series of tool barriers jointly defining uprightly aligned open areas for separate inserted reception of each of the tools, and arms carried by said front and rear frames and projecting horizontally and rearwardly therefrom and terminating in upwardly directed end segments, bracket means for securing said rack to the wall structure, and carried by said end segments and rearwardly offset from said frame members and defining an elongate open area for the reception of one or more fasteners for engagement with said bracket means and the wall structure at selected locations.

2. The storage rack claimed in claim 1 additionally including legs on on said lower series tool barriers for contact with the floor of the building structure.

3. The storage rack claimed in claim 1 wherein said arms partially define additional open areas for storage of elongate tools.

4. The storage rack claimed in claim 1 wherein said bracket means extend substantially the length of said rack said elongate open area terminating adjacent a distal end segment of each of said arms.

* * * * *